United States Patent [19]

McNeil

[11] Patent Number: 4,526,595

[45] Date of Patent: Jul. 2, 1985

[54] PLANT FOR PRODUCING GASEOUS NITROGEN

[75] Inventor: Brian A. McNeil, Surrey, United Kingdom

[73] Assignee: Air Products and Chemicals, Inc., Allentown, Pa.

[21] Appl. No.: 538,256

[22] Filed: Oct. 3, 1983

[30] Foreign Application Priority Data

Oct. 27, 1982 [GB] United Kingdom ..... 8230740

[51] Int. Cl.[3] ..... F25J 3/02

[52] U.S. Cl. ..... 62/28; 62/29; 62/31; 62/34; 62/39

[58] Field of Search ..... 62/31, 34, 38, 39, 9, 62/11, 23, 24, 27, 28, 29, 30, 32, 33, 42, 18

[56] References Cited

U.S. PATENT DOCUMENTS 3,056,268 10/1962 Grenier ..... 62/31

4,400,188 8/1983 Patel et al. ..... 62/31

*Primary Examiner*—Frank Sever

*Attorney, Agent, or Firm*—Carol A. Nemetz; James C. Simmons; E. Eugene Innis

[57] ABSTRACT

A plant for producing gaseous nitrogen, which plant comprises a heat exchanger (6) for cooling feed air, a distillation column (8) for receiving at least part of said feed air, a vessel (21), a reflux condenser (12) disposed in said vessel (21) and arranged to receive, in use, vapor from said distillation column (8) and return liquid reflux thereto, a line (18,20) connecting the lower portion of said distillation column (8) to said vessel (21) and having an expansion valve (19) mounted therein, a line (14) for withdrawing nitrogen product from said distillation column (8) and bringing said nitrogen product into heat exchange with said feed air, a crude liquid oxygen (LOX) storage tank (27) communicating with said vessel (21), a liquid nitrogen (LIN) storage tank (34) communicating with said distillation column (8), a line (22) for conveying waste gas from said vessel (21), means to warm said waste gas, an expander (24) to expand said waste gas, means to control the flow of waste gas through said expander, and means to effect heat exchange between the expanded waste gas and the feed air.

2 Claims, 2 Drawing Figures

PLANT FOR PRODUCING GASEOUS NITROGEN

Figure 1:
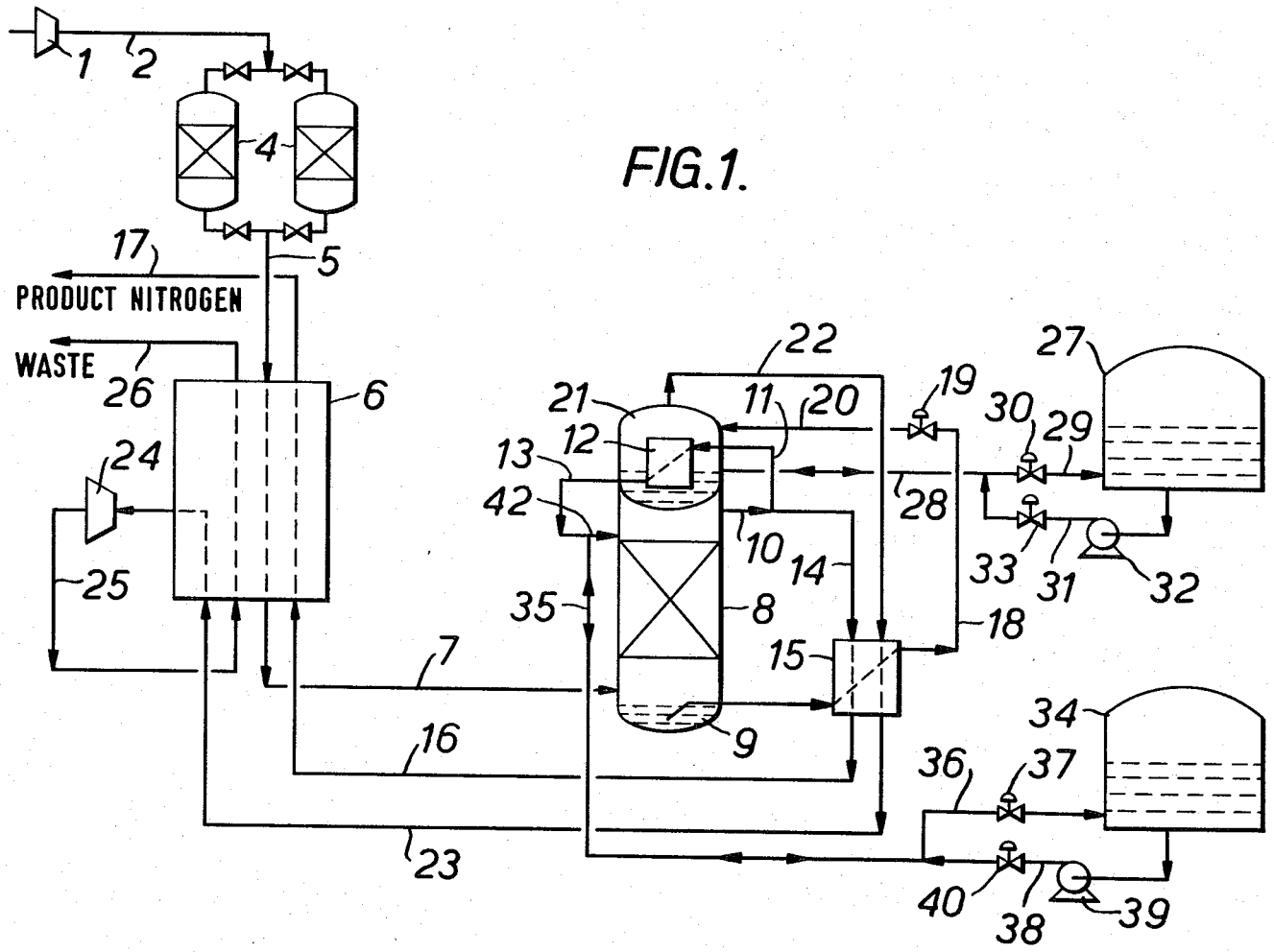

This invention relates to a plant for producing gaseous nitrogen.

In conventional air separation plants it is possible to reduce the production rate by as much as 50%. However, such changes cannot be effected rapidly—typically taking about an hour (under computer control) if product quality is to be maintained.

For certain technical applications it is desirable to have a supply of nitrogen which can be greatly increased or reduced for short periods. Indeed, for certain applications it is desirable to be able to vary the production rate from zero to maximum output.

A similar desiderate has existed in relation to the production of gaseous oxygen and, in order to meet this problem, cryogenic engineers developed, in the late fifties, the Wechsel Speicher Process. The principle behind this process is that during periods of low oxygen demand the plant produces liquid oxygen which is sent to storage. In times of high oxygen demand the normal gaseous oxygen supply is supplemented by evaporating the liquid oxygen. The refrigeration balance on the plant is maintained by producing liquid nitrogen whilst liquid oxygen is evaporating and evaporating liquid nitrogen whilst liquid oxygen is being produced.

It has long been known that the principles of the Wechsel Speicher Process could be applied to the production of gaseous nitrogen. However, it has also been known from work on the production of gaseous oxygen that the production rate could not be varied rapidly without loss of product quality.

We have found that relatively rapid variation in production rate can be made without undue effect on product quality by providing, according to the present invention, a plant for producing gaseous nitrogen, which plant comprises a heat exchanger for cooling feed air, a distillation column for receiving at least part of said feed air, a vessel, a reflux condenser disposed in said vessel and arranged to receive, in use, vapour from said distillation column and return liquid reflux thereto, a line connecting the lower portion of said distillation column to said vessel and having an expansion valve mounted therein, a line for withdrawing nitrogen product from said distillation column and bringing said nitrogen product into heat exchange with said feed air, a crude liquid oxygen (LOX) storage tank communicating with said vessel, means to bring crude liquid oxygen from said crude LOX storage tank into heat exchange with vapour from said distillation column to provide reflux for said distillation column, a liquid nitrogen (LIN) storage tank communicating with said distillation column, means to return liquid nitrogen from said liquid nitrogen storage tank to said distillation column and/or vessel, a line for conveying waste gas from said vessel, means to warm said waste gas, an expander to expand said waste gas, means to control the flow of waste gas through said expander, and means to effect heat exchange between the expanded waste gas and the feed air.

Preferably, the vessel is a distillation column.

Figure 2:
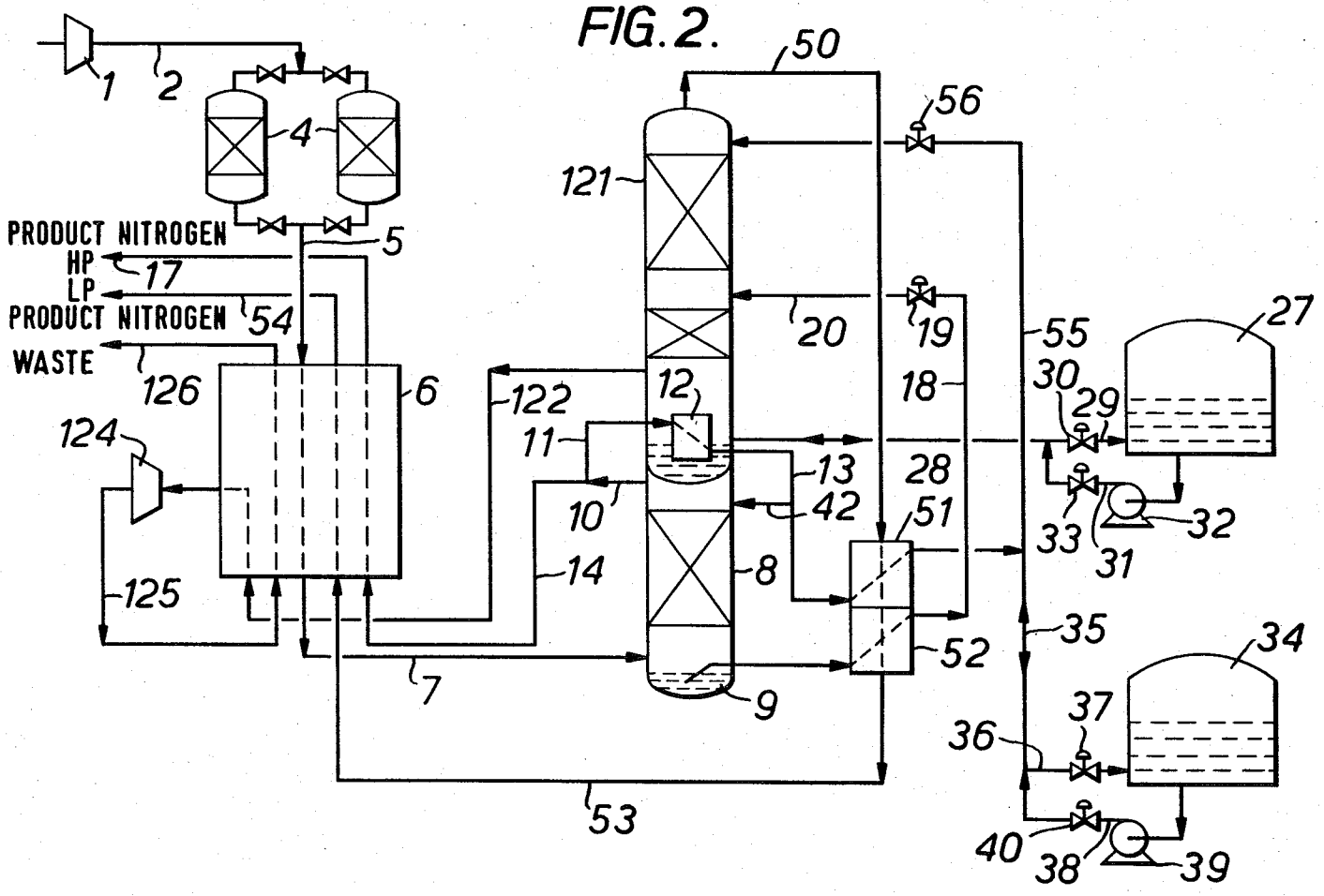

For a better understanding of the invention and to show how the same may be carried into effect, reference will now be made, by way of example, to the accompanying drawings which:

FIG. 1 is a simplified flow sheet of one embodiment of a plant for producing gaseous nitrogen in accordance with the invention; and FIG. 2 is a simplified flow sheet of a second embodiment of a plant for producing gaseous nitrogen in accordance with the invention.

Referring to FIG. 1 of the drawings, air is compressed to between 5 and 10 bars A in compressor 1 and is passed through line 2 to one of a pair of molecular sieve dryers 4 where water vapour and carbon dioxide are adsorbed.

The dry, carbon dioxide free air is then passed through line 5 to heat exchanger 6 where it is cooled to near its dew point. The cooled, dry carbon dioxide free air is then passed through line 7 into distillation column 8 where it is separated into a crude liquid oxygen (LOX) portion 9 and a gaseous nitrogen fraction which leaves the distillation column 8 through line 10. Part of the gaseous nitrogen fraction is passed through line 11 to condenser 12 where it is liquified before leaving the condenser 12 through line 13.

The balance of the gaseous nitrogen fraction from line 10 passes through line 14 to heat exchanger 15 where it is warmed before leaving through line 16. The nitrogen is then further warmed in heat exchanger 6 which it leaves through line 17 as product nitrogen.

The crude LOX portion 9 is sub-cooled in heat exchanger 15 and is passed through line 18 to valve 19 where it is expanded. It is then passed through line 20 into vessel 21. Vapour leaves vessel 21 through line 22, and after passing through heat exchanger 15 and line 23 is partially warmed in heat exchanger 6. The warm vapour is then expanded through expander 24 which it leaves through line 25 at a reduced temperature. The vapour is then passed through heat exchanger 6 which it leaves through conduit 26 and is vented to atmosphere as waste. A crude LOX storage tank 27 is connected to the vessel 21 via a reversible line 28, a line 29 having a valve 30, and a return line 31 provided with a pump 32 and a valve 33.

A liquid nitrogen (LIN) storage tank 34 is connected to line 13 via a reversible line 35, a line 36 having a valve 37, and a return line 38 provided with a pump 39 and a valve 40.

In order to explain the operation of the plant a base case will be assumed in which liquid is neither flowing to or from crude LOX storage tank 27 or LIN storage tank 34. Gaseous nitrogen is, however, being withdrawn from product nitrogen line 17 and valves 30, 33, 37 and 40 are all closed.

When nitrogen demand increases the flow through line 11 decreases. In order to maintain the reflux in the distillation column 8 constant pump 39 is activated and valve 40 opened.

Because of the decrease in flow through condenser 12 crude LOX accumulates in vessel 21 and this is passed through reversible line 28, open valve 30 and line 29 into crude LOX storage tank 27. Simultaneously, the flow through line 22 decreases and the guide vanes (not shown) on expander 24 are adjusted to maintain the pressure in distillation column 8 substantially constant. This reduces the flow through expander 24 and consequently reduces the amount of refrigeration available in line 25. However, this loss is offset by a corresponding increase in refrigeration available in line 16.

Should the nitrogen demand reduce from the base case then more nitrogen will pass through line 11 into condenser 12. In order to condense this additional nitrogen pump 32 is actuated and valve 33 opened. The additional crude LOX supplied to vessel 21 condenses the additional nitrogen. The amount of nitrogen returned to distillation column 8 as reflux remains constant whilst the excess is fed to LIN storage tank 34 via reversible line 35, line 36 and open valve 37. The additional flow of crude liquid oxygen to vessel 21 results in a much increased flow through line 22 and the guide vanes on expander 24 are adjusted to maintain the pressure in distillation column 8 substantially constant. This increases the flow through expander 24. However, the increased amount of refrigeration available in line 25 is offset by the decrease in refrigeration in line 16.

It will be appreciated that control of the plant described is relatively easy. In particular, bearing in mind that the air flow from compressor 1 is constant control centres on (a) maintaining the pressure in distillation column 8 substantially constant by varying the guide vanes on expander 24; and (b) maintaining the reflux flow through line 42 substantially constant, any deficit in flow being met from LIN storage tank 34 and any excess being metered to LIN storage tank 34 with, in each case, consequential amendments in the flow to or from crude LOX storage tank 27 to maintain the overall refrigeration balance.

The embodiment shown in FIG. 2 is generally similar to that shown in FIG. 1 and parts having similar functions to those in FIG. 1 have been identified by the same reference numeral. However, in this embodiment vessel 21 of FIG. 1 comprises a low pressure distillation column 121. A substantially pure low pressure nitrogen product stream leaves the top of low pressure distillation column 121 through line 50 and, after being warmed in heat exchangers 51 and 52, is passed through line 53 to heat exchanger 6 where it is further warmed before leaving through line 54. In addition, reversible line 35 is connected to the low pressure distillation column 121 by a line 55 provided with a valve 56.

Vapour also leaves the low pressure distillation column 121 through line 122. This vapour is warmed in heat exchanger 6 and then expanded in expander 124. The cold, expanded vapour leaves the expander 124 through line 125 and is warmed in heat exchanger 6 before being vented to atmosphere as waste through line 126.

In the embodiment shown it is intended that the production of low pressure nitrogen should be substantially constant and the flow of high pressure nitrogen variable. In order to explain the operation of the plant a base case will be assumed in which liquid is neither flowing to or from crude LOX storage tank 27 or LIN storage tank 34. Gaseous nitrogen is, however, being withdrawn through lines 17 and 54 and valves 30, 33, 37 and 40 are all closed.

When the demand for high pressure nitrogen increases the flow of nitrogen through line 11 decreases and accordingly less liquid is produced in reboiler/condenser 12. However, even at maximum high pressure nitrogen supply there is sufficient liquid formed in reboiler/condenser 12 to provide a constant flow of reflux liquid through line 42.

In view of the smaller flow through reboiler/condenser 12 the volume of crude LOX vaporized from the bottom of low pressure distillation column 121 decreases. In order to maintain the flow of vapour through the column constant the guide vanes on expander 124 are adjusted to reduce the flow through line 122. At the same time pump 39 is actuated and valve 40 opened to maintain the flow through line 55 substantially constant. In this way the ratio of moles of gas flowing up the distillation column 121 to moles of liquid travelling down the distillation column 121 remains substantially constant. However, because of the reduced amount of heat available from reboiler/condenser 12 crude liquid oxygen accumulates in the sump of the low pressure distillation column 121 and this is transferred to crude LOX storage tank 27 by opening valve 30. So far as concerns heat exchanger 6, the reduction in flow through expander 124 is largely offset by the increased flow of high pressure nitrogen through line 14.

In the case where the demand for high pressure nitrogen diminishes from the base case the flow of gaseous nitrogen through reboiler/condenser 12 increases. In order to condense the additional vapour pump 32 is started and valve 33 opened to allow crude LOX to flow into the sump of the low pressure distillation column 121. The flow of liquid nitrogen through lines 42 and 55 is maintained constant throughout the operation of the plant and the excess liquid nitrogen produced is passed through reversible line 35 to LIN storage tank 34 by opening valve 37. In order to maintain the flow of vapour up the low pressure distillation column 121 substantially constant the guide vanes on expander 124 are adjusted to increase the flow through line 122. So far as concerns heat exchanger 6, the reduced flow of nitrogen through line 14 is largely offset by the increased flow through expander 124.

It should be noted that whilst the plants described are primarily intended for operation with a constant air supply it is also possible to maintain a constant high pressure nitrogen supply at different air supply rates. However, it should be noted that changes in air supply could not be effected rapidly without upsetting the product quality and this mode of operation is only recommended where there are power tariffs which vary according to the time of day or day of the week.

I claim:

1. A plant for producing gaseous nitrogen, which plant comprises means designed for enabling rapid variation in production rate while maintaining product quality, including a heat exchanger for cooling feed air, a distillation column for receiving at least part of said feed air, a vessel, a reflux condenser disposed in said vessel and arranged to receive, in use, vapour from said distillation column and return liquid reflux thereto, a line connecting the lower portion of said distillation column to said vessel and having an expansion valve mounted therein, a line for withdrawing nitrogen product from said distillation column and bringing said nitrogen product into heat exchange with said feed air, a crude liquid oxygen (LOX) storage tank communicating with said vessel, means to bring crude liquid oxygen from said crude LOX storage tank into heat exchange with vapour from said distillation column to provide reflux for said distillation column, a liquid nitrogen (LIN) storage tank communicating with said distillation column, means to return liquid nitrogen from said liquid nitrogen storage tank to said distillation column and/or vessel, a line for conveying waste gas from said vessel, means to warm said waste gas, an expander to expand said waste gas, means to control the flow of waste gas through said expander, and means to effect heat exchange between the expanded waste gas and the feed air.

2. A plant as claimed in claim 1, wherein said vessel is a distillation column.

* * * * *